US011225622B1

(12) United States Patent
Monroe et al.

(10) Patent No.: US 11,225,622 B1
(45) Date of Patent: Jan. 18, 2022

(54) COMPOUNDS THAT INDUCE OCTANE OVERBOOSTING

(71) Applicant: National Technology & Engineering Solutions of Sandia, LLC, Albuquerque, NM (US)

(72) Inventors: Eric Monroe, Waltham, MA (US); Ryan Wesley Davis, San Jose, CA (US); Anthe George, San Francisco, CA (US); Joseph Carlson, Castro Valley, CA (US); Nicholas Myllenbeck, Livermore, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 17/151,808

(22) Filed: Jan. 19, 2021

(51) Int. Cl.

| | |
|---|---|
| ***C10L 10/10*** | (2006.01) |
| ***C10L 1/06*** | (2006.01) |
| ***C10L 1/182*** | (2006.01) |
| ***C10L 1/16*** | (2006.01) |

(52) U.S. Cl.
CPC ..... *C10L 10/10* (2013.01); *C10L 1/06* (2013.01); *C10L 1/1608* (2013.01); *C10L 1/1824* (2013.01); *C10L 2200/0423* (2013.01); *C10L 2200/0469* (2013.01); *C10L 2270/023* (2013.01); *C10L 2290/24* (2013.01)

(58) Field of Classification Search
CPC .... B60L 2270/30; B60L 53/14; B60L 53/305; B60L 53/31; B60L 53/65; B60L 53/665; G06K 9/00885; G06Q 20/14; G06Q 20/145; G07F 15/005; H04N 5/2252; H04N 5/772; H04N 7/183; Y02T 10/70; Y02T 10/7072; Y02T 90/12; Y02T 90/14; Y02T 90/16; Y02T 90/167; Y02T 90/169; Y04S 30/12; Y04S 30/14
See application file for complete search history.

(56) References Cited

U.S. PATENT DOCUMENTS

| | | | | |
|---|---|---|---|---|
| 4,310,709 | A | 1/1982 | Rebafka | |
| 8,481,974 | B1 | 7/2013 | Davis et al. | |
| 8,790,542 | B2 | 7/2014 | Dibble et al. | |
| 9,403,915 | B2 | 8/2016 | Dibble et al. | |
| 10,077,454 | B1 | 9/2018 | Davis et al. | |
| 10,112,916 | B2 | 10/2018 | Sathitsuksanoh et al. | |
| 2009/0020090 | A1* | 1/2009 | Ryder | C10L 1/06 123/1 A |
| 2016/0332914 | A1* | 11/2016 | Gadt | C04B 24/2629 |

OTHER PUBLICATIONS

U.S. Appl. No. 15/066,651, filed Mar. 10, 2016, Wu et al.
U.S. Appl. No. 15/447,567, filed Mar. 2, 2017, Davis et al.
U.S. Appl. No. 16/388,385, filed Apr. 18, 2019, Davis et al.
American Petroleum Institute, "Determination of the potential property ranges of mid-level ethanol blends," Washington, DC, 2010 (107 pp.).
Anderson JE et al., "Octane numbers of ethanol-gasoline blends: measurements and novel estimation method from molar composition," *SAE Technical Paper No. 2012-01-1274*, 2012 (17 pp.).
Boot MD et al., "Impact of fuel molecular structure on auto-ignition behavior-design rules for future high performance gasolines," *Prog. Energ. Combust. Sci.* 2017;60:1-25.
Bu L et al., "Understanding trends in autoignition of biofuels: homologous series of oxygenated C5 molecules," *J. Phys. Chem. A* 2017;121:5475-86.
Cai L et al., "Optimized chemical mechanism for combustion of gasoline surrogate fuels," *Combust. Flame* 2015;162:1623-37.
Chou HH et al., "Synthetic pathway for production of five-carbon alcohols from isopentenyl diphosphate," *Appl. Environ. Microbiol.* 2012;78:7849-55.
Chow EW et al., "Benefits of a higher octane standard gasoline for the U.S. light-duty vehicle fleet," *SAE Technical Paper No. 2014-01-1961*, 2014, (18 pp.).
Christensen E et al., "Renewable oxygenate blending effects on gasoline properties," *Energy Fuels* 2011;25:4723-33.
Davis, et al., "U.S. Appl. No. 16/438,763", filed Jun. 12, 2019, 35 pages.
Ershov, et al., "Characteristics of Isohexene as a Novel Promising High-Octane Gasoline Booster", In Energy Fuels, vol. 34, No. 7, Jun. 1, 2020, pp. 8139-8149.
Foong TM et al. "The octane numbers of ethanol blended with gasoline and its surrogates," *Fuel* 2014;115:727-39.
George KW et al., "Metabolic engineering for the high-yield production of isoprenoid-based $C_5$ alcohols in *E. coli," Sci. Rep.* 2015;5: Art. No. 11128 (12 pp.).
Ghosh P et al., "Development of a detailed gasoline composition-based octane model," *Ind. Eng. Chem. Res.* 2006;45:337-45.
Giglio V et al., "Experimental evaluation of reduced kinetic models for the simulation of knock in SI engines," *SAE Int'l Technical Paper No. 2011-24-0033*, 2011 (11 pp.).
Graham, Chantel Loran, "Office Action for U.S. Appl. No. 16/438,763", dated Jun. 29, 2020, 6 pages.
Graham, Chantel Loran, "Notice of Allowance for U.S. Appl. No. 16/438,763", dated Sep. 18, 2020, 8 pages.
Farber, Madelynne J., "Response to the Office Action for U.S. Appl. No. 16/438,763", filed Sep. 2, 2020, 7 pages.
Hoelderich WF et al., "Heterogeneously catalysed oxidations for the environmentally friendly synthesis of fine and intermediate chemicals: synergy between catalyst development and reaction engineering," in *Catalysis* (vol. 16, JJ Spivey (senior reporter)), The Royal Society of Chemistry, Cambridge, UK, 2002, Chapter 2, pp. 43-66.

(Continued)

*Primary Examiner* — Ellen M McAvoy
*Assistant Examiner* — Chantel L Graham
(74) *Attorney, Agent, or Firm* — Medley, Behrens & Lewis, LLC; Madelynne J. Farber

(57) ABSTRACT

A fuel mixture includes a fuel and an octane overboosting additive. Methods of preparing and using such mixtures are disclosed. In particular, the mixture includes an additive that provides octane boosting that produces peak octane at or before a 40% blend and produces at least a 1 octane boost at 10% volume of additive to fuel mixture.

19 Claims, 6 Drawing Sheets

(56) References Cited

OTHER PUBLICATIONS

Hunwartzen I, "Modification of CFR test engine unit to determine octane numbersof pure alcohols and gasoline-alcohol blends," *SAE Technical Paper Series No. 820002*, 1982 (6 pp.).
Inal F et al., "Effects of oxygenate additives on polycyclic aromatic hydrocarbons (PAHs) and soot formation," *Combustion Sci. Technol.* 2002;174:1-19.
Kogan SB et al., "Liquid phase isomerization of isoprenol into prenol in hydrogen environment," *Appl. Catal. A* 2006;297:231-6.
Lovell WG, "Knocking characteristics of hydrocarbons," *Ind. Eng. Chem.* 1948;40:2388-438.
Mack JH et al., "Investigation of biofuels from microorganism metabolism for use as anti-knock additives," *Fuel* 2014;117:939-43.
Maylin MV et al., "Calculation of gasoline octane numbers taking into account the reaction interaction of blend components," *Procedia Chem.* 2014;10:477-84.
McCormick RL et al., "Selection criteria and screening of potential biomass-derived streams as fuel blendstocks for advanced spark-ignition engines," *SAE Int'l J. Fuels Lubr.* 2017;10:442-60.
Mehl M et al., "An approach for formulating surrogates for gasoline with application toward a reduced surrogate mechanism for CFD engine modeling," *Energy Fuels* 2011;25:5215-23.
Mittal V et al., "The shift in relevance of fuel RON and MON to knock onset in modern SI engines over the last 70 years," *SAE Int'l J. Engines* 2010;2(2):1-10.
Monroe E et al., "Discovery of novel octane hyperboosting phenomenon in prenol biofuel/gasoline blends," *Fuel* 2019;239:1143-8.
Monroe E et al., Appendix A, Supplementary Data for "Discovery of novel octane hyperboosting phenomenon in prenol biofuel/gasoline blends," *Fuel* 2019;239:1143-8 (18 pp.).
Morganti KJ et al., "The Research and Motor Octane Numbers of Liquefied Petroleum Gas (LPG)," *Fuel* 2013;108:797-811.
Mueller CJ et al., "Diesel surrogate fuels for engine testing and chemical-kinetic modeling: compositions and properties," *Energy Fuels* 2016;30:1445-61.
Nriagu JO, "The rise and fall of leaded gasoline," *Sci. Total Environ.* 1990;92:13-28.
Pan J et al., "Research on in-cylinder pressure oscillation characteristic during knocking combustion in spark-ignition engine," *Fuel* 2014;120:150-7.
Park S et al., "Combustion characteristics of $C_5$ alcohols and a skeletal mechanism for homogeneous charge compression ignition combustion simulation," *Energy Fuels* 2015;29:7584-94.
Scott EJY, "Knock characteristics of hydrocarbon mixtures," *Proc. Am. Petrol. Inst., Sect. III.* 1958;38:90-111 (abstract only, 1 page).
Solomon BD et al., "Grain and cellulosic ethanol: history, economics, and energy policy," *Biomass Bioenerg.* 2007;31:416-25.
Splitter D et al., "A historical analysis of the co-evolution of gasoline octane number and spark-ignition engines," *Front. Mech. Eng.* 2016;1:Art. 16 (22 pp.).
Squillace PJ et al., "Preliminary assessment of the occurrence and possible sources of MTBE in groundwater in the United States, 1993-1994," *Environ. Sci. Technol.* 1996;30:1721-30.
Stein RA et al., "Effect of heat of vaporization, chemical octane, and sensitivity on knock limit for ethanol—gasoline blends," *SAE Int'l J. Fuels Lubr.* 2012;5:823-43.
Stradling R et al., "Effect of octane on performance, energy consumption and emissions of two Euro 4 passenger cars," *Transport. Res. Procedia* 2016;14:3159-68.
Szybist JP et al., "Understanding chemistry-specific fuel differences at a constant RON in a boosted SI engine," *Fuel* 2018;217:370-81.
Vuilleumier D et al., "The use of transient operation to evaluate fuel effects on knock limits well beyond RON Conditions in spark-ignition engines," *SAE Technical Paper No. 2017-01-2234*, 2017 (14 pp).
Wallner T et al., "Analytical assessment of C2-C8 alcohols as spark-ignition engine fuels," *Proceedings of the FISITA 2012 World Automotive Congress* (Society of Automotive Engineers of China (SAE-China) and International Federation of Automotive Engineering Societies (FISITA), eds.), Springer-Verlag Berlin Heidelberg, Germany, 2013, pp. 15-26.
Wang Z et al., "Knocking combustion in spark-ignition engines," *Prog. Energy Combustion Sci.* 2017;61:78-112.
Westbrook CK et al., "Chemical kinetics of octane sensitivity in a spark-ignition engine," *Combust. Flame* 2017;175:2-15.
Westbrook CK et al., "A new chemical kinetic method of determining RON and MON values for single component and multicomponent mixtures of engine fuels," *Combust. Flame* 2018;195:50-62.
Zheng Y et al., "Metabolic engineering of *Escherichia coli* for high-specificity production of isoprenol and prenol as next generation of biofuels," *Biotechnol. Biofuels* 2013;6:57 (13 pp.).

* cited by examiner

| Compound | Structure | Method of Generation | Base Fuel Used | Volume % of Compound Blended into Base Fuel | | | | | | | | | | |
|---|---|---|---|---|---|---|---|---|---|---|---|---|---|---|
| | | | | 0 | 10 | 20 | 30 | 40 | 50 | 60 | 70 | 80 | 90 | 100 |
| Prenol |  | Purchased | 4 Component Surrogate | 89.6 | 93.38 | 95.96 | 97.2 | 97.2 | 96.9 | 96.4 | 95.8 | 94.8 | 94.3 | 93.9 |
| Myrcene |  | Purchased | PNNL CaRBCM 3 | 87.4 | 91.4 | 91.8 | 91.8 | 89.7 | 88.3 | 85.6 | - | 82.9 | - | 82.5 |
| Allo-ocimene |  | Purchased | RD 587 | 91.9 | 93.3 | 91.2 | - | 89.3 | - | 84 | - | - | - | - |
| 2,3 dimethyl-2-butene |  | Purchased | 4 Component Surrogate | 89.6 | 95.1 | 97.2 | 97.3 | 97.5 | - | - | - | - | - | - |
| Geraniol |  | Purchased | RD 587 | 91.9 | 94.1 | 95 | 94.6 | 93.7 | - | - | - | - | - | - |
| Limonene |  | Purchased | SNL CaRBCM 3 E10 | 92.2 | 95.1 | 94.6 | 94.4 | - | - | - | - | - | - | - |
| Dimethyl Prenol |  | Synthesized | PRF 100 | 100 | - | 106.3 | - | - | - | - | - | - | - | 103.1 |

COMPOUNDS THAT INDUCE OCTANE OVERBOOSTING

STATEMENT OF GOVERNMENT INTEREST

This invention was made with Government support under Contract No. DE-NA0003525 awarded by the United States Department of Energy/National Nuclear Security Administration. The Government has certain rights in the invention.

FIELD

The technology disclosed herein relates to fuel mixtures and methods of preparing such mixtures. In particular, the mixture includes an additive that provides octane boosting.

BACKGROUND

The ability to accurately predict engine performance based on an understanding of basic fuel chemistry has been a major goal of combustion science and engineering since the advent of the internal combustion engine. As mid-to-low boiling range petroleum distillates became the standard raw material to power spark ignition (SI) combustion engines, a significant quantity of SI combustion research has focused on identifying fuel additives that could increase a fuel's ability to resist autoignition, and thereby prevent a phenomenon known as engine knock (see, e.g., Mittal V et al., "The shift in relevance of fuel RON and MON to knock onset in modern SI engines over the last 70 years," *SAE Int'l J. Engines* 2010; 2(2):1-10; and Wang Z et al., "Knocking combustion in spark-ignition engines," *Prog. Energy Combustion Sci.* 2017; 61:78-112).

Historically, additives such as tetra-ethyl lead (TEL) and methyl tert-butyl ether (MTBE) were used to minimize engine knock (e.g., Nriagu J O, "The rise and fall of leaded gasoline," *Sci. Total Environ.* 1990; 92:13-28). However, health and environmental risks associated with these additives resulted in each being phased out of the U.S. market, with ethanol becoming the dominant oxygenate and octane enhancer for gasoline blending by the mid-2000s (see, e.g., Solomon B D et al., "Grain and cellulosic ethanol: history, economics, and energy policy," *Biomass Bioenerg.* 2007; 31:416-25; and Squillace P J et al., "Preliminary assessment of the occurrence and possible sources of MTBE in groundwater in the United States, 1993-1994," *Environ. Sci. Technol.* 1996; 30:1721-30).

Engine knock is associated with a host of other issues negatively impacting spark ignition engine longevity, including piston melt, gasket leakage, cylinder bore scuffing, and cylinder head erosion (see, e.g., Heywood J B, "Internal combustion engine fundamentals," McGraw-Hill, Inc., New York, N.Y., 1988, 930 pp.). The impact of higher octane fuels can be significant, with Heywood et al. reporting that if the RON of gasoline was globally raised to 98, overall greenhouse gas emissions would be 4.5-6% lower than the baseline case of lower octane gasoline (see, e.g., Chow E W et al., "Benefits of a higher octane standard gasoline for the U.S. light-duty vehicle fleet," *SAE Technical Paper No.* 2014-01-1961, 2014, 18 pp.). Other studies have demonstrated similar benefits of higher octane fuels (see, e.g., Stradling R et al., "Effect of octane on performance, energy consumption and emissions of two Euro 4 passenger cars," *Transport. Res. Procedia* 2016; 14:3159-68; and Pan J. et al., "Research on in-cylinder pressure oscillation characteristic during knocking combustion in spark-ignition engine," *Fuel* 2014; 120:150-7).

If the RON enhancement is due to a renewable bioderived fuel, these benefits are further increased due to displacement of fossil fuels. Improving the behavior of bioderived fuels in blends is of additional importance because, as with ethanol, it is anticipated that new biofuels will be added to a base fuel rather than used neat.

Numerous studies have been conducted to understand the RON and MON performance of both neat compounds and blended fuels (see, e.g., American Society for Testing Materials, "Knocking characteristics of pure hydrocarbons," *ASTM Special Technical Pub. No.* 225, Philadelphia, Pa., 1958; Ghosh P et al., "Development of a detailed gasoline composition-based octane model," *Ind. Eng. Chem. Res.* 2006; 45:337-45; Lovell W G, "Knocking characteristics of hydrocarbons," *Ind. Eng. Chem.* 1948; 40:2388-438; and Morganti K J et al., "The Research and Motor Octane Numbers of Liquefied Petroleum Gas (LPG)," Fuel 2013; 108:797-811). More recently efforts have focused on using first principles approaches, such as chemical kinetics to predict antiknock properties, however, these have been limited to low complexity fuel surrogates and computational modeling approaches (see, e.g., Boot M D et al., "Impact of fuel molecular structure on auto-ignition behavior-design rules for future high performance gasolines," *Prog. Energ. Combust. Sci.* 2017; 60:1-25; Bu L et al., "Understanding trends in autoignition of biofuels: homologous series of oxygenated C5 molecules," *J. Phys. Chem. A* 2017; 121: 5475-86; Westbrook C K et al., "Chemical kinetics of octane sensitivity in a spark-ignition engine," *Combust. Flame* 2017; 175:2-15; Szybist J P et al., "Understanding chemistry-specific fuel differences at a constant RON in a boosted SI engine," *Fuel* 2018; 217:370-81; Maylin M V et al., "Calculation of gasoline octane numbers taking into account the reaction interaction of blend components," *Procedia Chem.* 2014; 10:477-84; and Giglio V et al., "Experimental evaluation of reduced kinetic models for the simulation of knock in SI engines," *SAE Intl Technical Paper No.* 2011-24-0033, 2011, 11 pp.). Despite these efforts, a detailed understanding of why certain fuel additives blend synergistically (i.e. generate higher octane number than that which would be predicted based on the relative mole fraction of the additive and a linear blending rule), while others blend antagonistically is still not well understood. See FIG. 1. This is because these phenomena intrinsically depend on chemical interactions among the numerous components of the fuel blend in the combustion cycle (see, e.g., Boot M D et al., *Prog. Energ. Combust. Sci.* 2017; 60:1-25; American Petroleum Institute, "Determination of the potential property ranges of mid-level ethanol blends," Washington, D C, 2010, 107 pp.; Park S et al., "Combustion characteristics of $C_5$ alcohols and a skeletal mechanism for homogeneous charge compression ignition combustion simulation," *Energy Fuels* 2015; 29:7584-94; Wallner T et al., "Analytical assessment of C2-C8 alcohols as spark-ignition engine fuels," *Proceedings of the FISITA* 2012 World Automotive Congress (Society of Automotive Engineers of China (SAE-China) and International Federation of Automotive Engineering Societies (FISITA), eds.), Springer-Verlag Berlin Heidelberg, Germany, 2013, pp. 15-26; Anderson J E et al., "Octane numbers of ethanol-gasoline blends: measurements and novel estimation method from molar composition," *SAE Technical Paper No.* 2012-01-1274, 2012, 17 pp.; and Stein R A et al., "Effect of heat of vaporization, chemical octane, and sensitivity on knock limit for ethanol—gasoline blends," *SAE Intl J. Fuels Lubr.* 2012; 5:823-43).

In previous efforts to identify new fuel additives for increasing engine efficiency, hundreds of biofuel molecules have been evaluated for neat RON and MON to establish suitability as an octane boosting or antiknock agent (see, e.g., Morganti K J et al., Fuel 2013; 108:797-811; Mack J H et al., "Investigation of biofuels from microorganism metabolism for use as anti-knock additives," *Fuel* 2014; 117:939-43; Christensen E et al., "Renewable oxygenate blending effects on gasoline properties," *Energy Fuels* 2011; 25:4723-33; and McCormick R L et al., "Selection criteria and screening of potential biomass-derived streams as fuel blendstocks for advanced spark-ignition engines," *SAE Int'l J. Fuels Lubr.* 2017; 10:442-60). The RON of the neat compound is commonly used to interpolate the maximum RON of the resulting fuel blend since it widely assumed that the RON of a mixture will never exceed the bounds of the RON values for its constituents (the compound and the blendstock).

Fuel chemistry can be designed to enhance engine performance, fuel stability, and octane content. Additives can be included to provide such beneficial properties, but the identification of such additives and their properties still remains a challenge. Why some compounds improve octane of a fuel when blended therein and others blend antagonistically (decreasing octane) is still not well understood. It is common for octane boosting compounds to boost octane to a level between the octane of the neat fuel and the octane of the neat additive. While this effect can be valuable, improving the octane boosting effect of such compounds is desirable, so that less additive is needed to attain a desired octane improvement. In addition, some applications may benefit from boosting the fuel octane higher than has been conventionally achieved. In addition, octane boosters that can be sourced from renewable biological sources are desirable. Accordingly, there is a need for new fuel additives and fuel mixtures that display improved properties.

SUMMARY

In an embodiment, additives for fuels are disclosed for increasing octane numbers that can improve the operation of combustion engines, especially in high compression environments. The phenomenon also increases the potential candidate list of high performance biofuels. Potential fuels and compounds hitherto discounted due to their lower pure component RON may exhibit overboosting behavior and thereby enhance performance in blends.

In an embodiment, the method includes (e.g., before the blending step): purifying the additive by removing one or more polar contaminants, thereby providing a purified additive. In other embodiments, the purified additive does not include a peroxide or a hydrate.

In an embodiment, the method includes (e.g., after the blending step): determining a RON of the fuel mixture that is greater than a RON of the neat additive and the fuel.

By "alkenol" is meant an optionally substituted alkenyl group, as defined herein, substituted by one or more hydroxyl groups, as defined herein. Exemplary alkenols include $R^A$—OH, where $R^A$ is optionally substituted alkenyl (e.g., optionally substituted $C_{2-24}$, $C_{2-22}$, $C_{2-20}$, $C_{2-18}$, $C_{2-16}$, $C_{2-14}$, $C_{2-12}$, $C_{2-10}$, $C_{2-9}$, $C_{2-8}$, $C_{2-7}$, $C_{2-6}$, $C_{2-5}$, or $C_{2-4}$ alkenyl group). Further exemplary alkenols include prenol (3-methyl-2-buten-1-ol), isoprenol (3-methyl-3-buten-1-ol), 2-methyl-3-buten-2-ol, as well as any described herein. Yet another alkenol includes an optionally substituted pentenol (e.g., a $C_5$ alkenol) that can be linear or branched.

By "alkenyl" is meant an optionally substituted $C_{2-24}$ alkyl group, as defined herein, having one or more double bonds. The alkenyl group can be cyclic (e.g., $C_{3-24}$ cycloalkenyl) or acyclic. The alkenyl group can also be substituted or unsubstituted. For example, the alkenyl group can be substituted with one or more substitution groups, as described herein for alkyl.

By RON is meant Research Octane Number, and is determined by ASTM International, "Standard test method for Research Octane Number of spark-ignition engine fuel," Designation No. ASTM D2699-16, West Conshohocken, Pa., 2016, incorporated herein by reference.

DETAILED DESCRIPTION

Octane boosting additives that are capable of increasing octane to a level even higher than the neat additive, or at surprisingly high effect at a low level (i.e., overboosting compounds) are disclosed herein. This expands on previous work showing that prenol works as a hyperboosting compound, as disclosed in U.S. application Ser. No. 16/438,763, filed on Jun. 12, 2019, incorporated herein by reference for all purposes. The term octane, as used herein, means Research Octane Number (RON) values. An increased RON indicates a higher octane fuel having improved resistance to autoignition. Generally, the RON of a fuel mixture does not exceed the RON of its individual components. Thus, when an additive is included within the fuel, it is assumed that the RON of a mixture will never exceed the bounds of the RON for the additive. While the overboosting effect disclosed herein includes compounds that provide RON enhancements, in which the RON of the fuel mixture exceeds that of the base fuel and the additive. In other embodiments, at low levels the RON enhancement is surprisingly high at low levels, but may taper off as higher additive amounts are added. This is still considered an overboosting effect, given the very high levels of enhancement at low concentrations.

Figure 1:
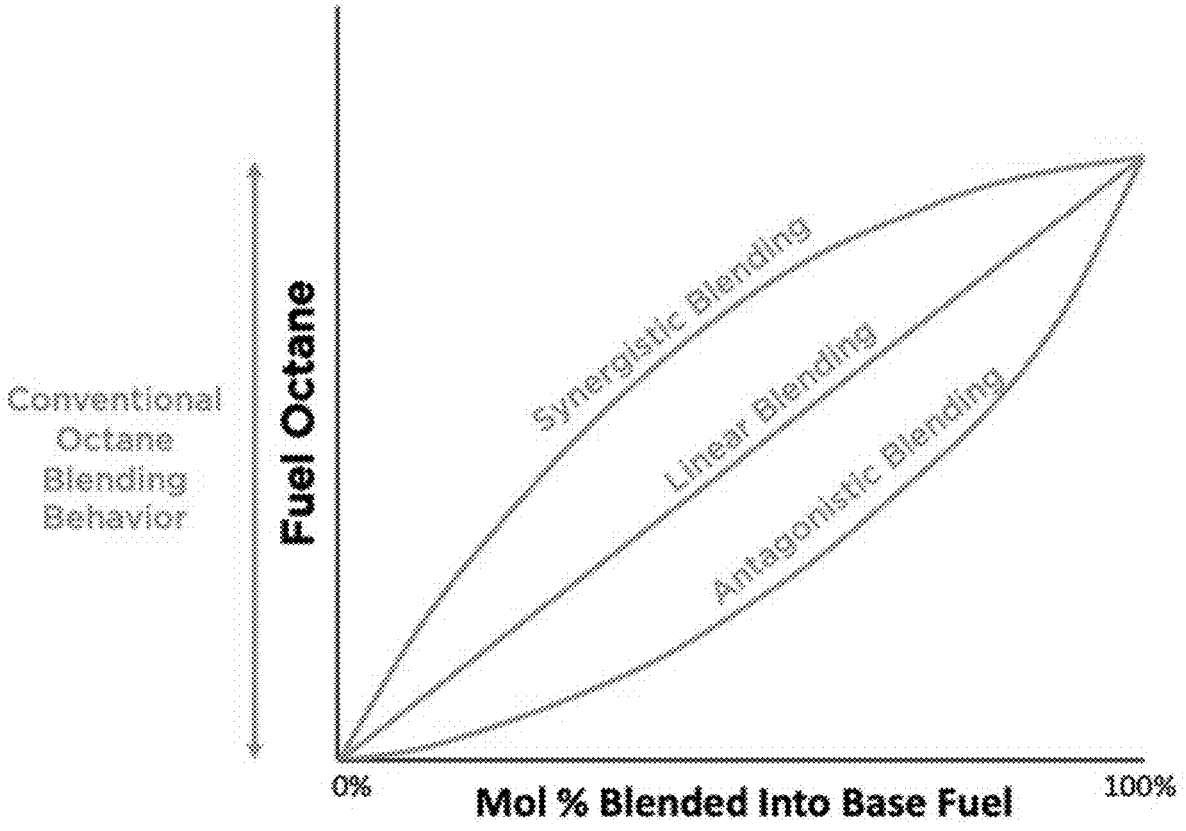
FIG. 1 is a graph showing conventional synergistic and antagonistic blending.

Overboosting, as that term is used herein is contrasted with an effect known as synergistic blending (see FIG. 1), which merely is the generation of a higher octane number than that which would be predicted based on the relative mole fraction of the additive and a linear blending rule. The overboosting effect disclosed herein is a an even greater increase in octane levels.

Higher octane is associated with lower reactivity and can prevent knocking in an engine. In addition, the lower reactivity (indicative of a higher RON) that the additive compounds provide can enable engines to run with higher compression ratios (CR), which can increase efficiency and/or power density. In some embodiments, for example, it may be desirable to increase the CR and run naturally aspirated (zero boost). In some embodiments, both CR and boost may both be raised. In others, the CR is not altered, but the boost is raised to higher levels. These options can be adjusted for desired performance and fuel economy, e.g., in economy vehicles, sports cars, and race cars.

Figure 2:
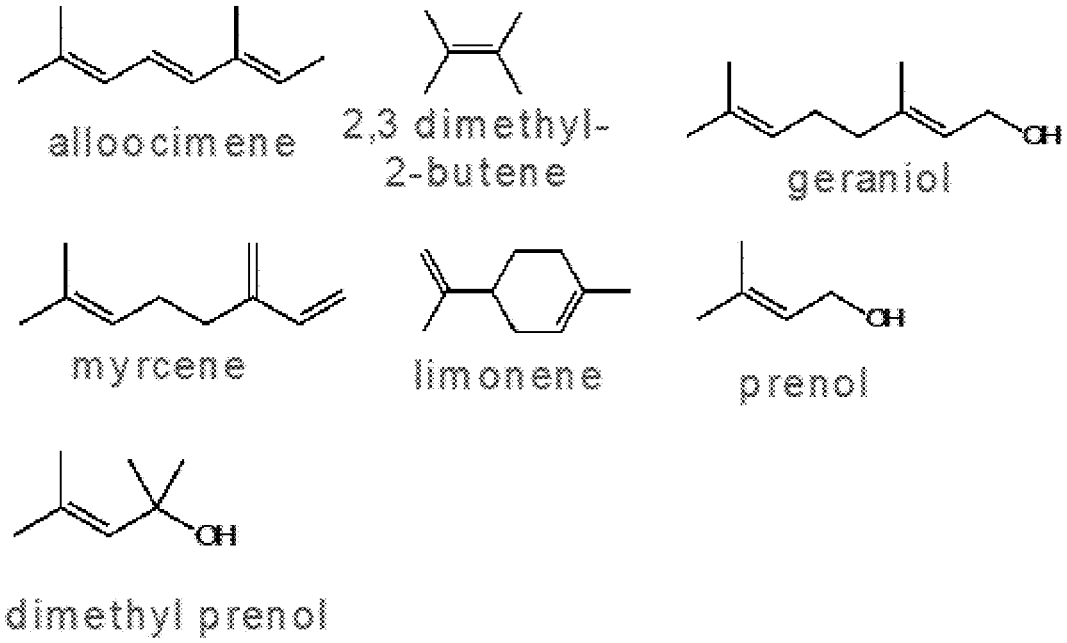
FIG. 2 shows chemical structures for certain overboosting compounds disclosed herein.

In an embodiment, the additive is selected from the group consisting of: myrcene, geraniol, 2,3-dimethyl-2-butene, alloocimene, limonene, dimethyl prenol, or combinations thereof. FIG. 2 shows chemical structures for these compounds. In an embodiment, for these additives, RON enhancements of least 1 RON are observed, and the RON of the fuel blend peaks at or before 40% of additive volume (v/v). In addition, these compounds produce an initial boost of at least 1 RON at 10% additive (v/v). In another embodiment, the overboosting effect can be described by the following criteria:

1) A mixture of the additive compound and the base fuel has a RON value that is higher than either the RON of the base fuel itself or the additive compound itself.

2) In instances where the RON of the additive compound cannot be measured due to instrument limitations (for example, the additive compound has a boiling point too high to be accurately measured) or due to sample volume limitations, a function fit to data points on graph of the RON blend with at least RON measurements taken every 10% of additive volume, has a generally downward facing parabola with an inflection point and a second derivative of zero.

In criteria 1 and 2, the delta between the maximum RON value and the most extreme low values must be larger than the established repeatability of the measurement outlined in the ASTM D2699 method.

In an embodiment, the overboosting compounds are alkenyl compounds, more particularly $C_5$-$C_{24}$, or $C_6$-$C_{10}$ alkenyls, and contain one or more internal carbon-carbon double bonds (C=C bonds). In addition, each of these compounds has multiple carbon atoms with no covalent bond to a hydrogen atom and/or multiple carbon atoms with covalent bonds only to other carbon atoms. Prenol may be mentioned here too and is included in certain examples, however, it is the subject of the prior application, U.S. Ser. No. 16/438,763, filed on Jun. 12, 2019 and incorporated by reference.

Figure 3:
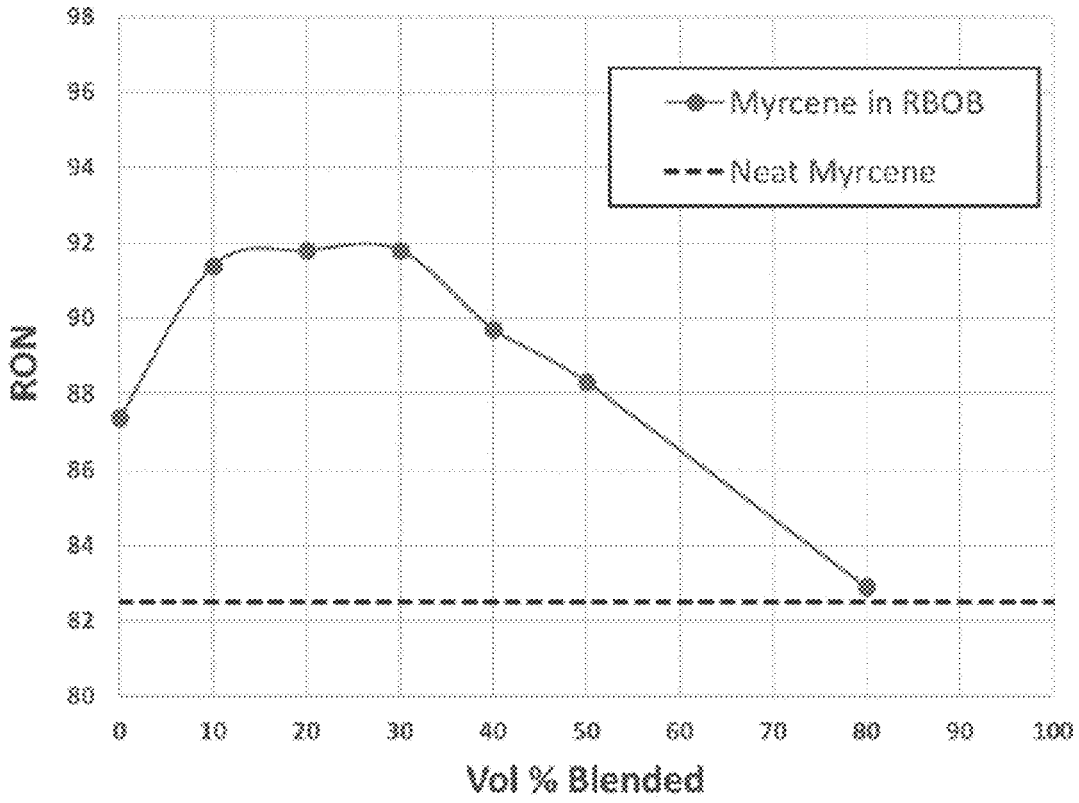
FIG. 3 is a graph showing a blend profile of myrcene with an RBOB fuel. The dotted line represents the RON of neat myrcene.

The effect is not distributed equally amongst the group of overboosting compounds. Limonene and 2,3-dimethyl-2-butene represent the low end of the spectrum, while myrcene is near the top of the list for the most dramatic demonstration of this effect. A blend of myrcene in a commercial gasoline had a RON of 94.4 while neat myrcene is only 83. This is a hyperboosting effect of >11 ON that shows the extreme impact this effect can have on biorefining strategies. The myrcene results are shown in FIG. 3. Note that the peak octane occurs prior to 40% of the additive, the octane is boosted over 1 octane at only 10% additive volume, and the blend has a higher octane than neat myrcene, at least until about 80% additive volume in the blend. Other blend profiles for the overboosting additives are discussed in the Examples.

It is notable that some of the compounds shown disclosed herein have not yet had or cannot have their neat RON value measured (because of their boiling point and/or corrosiveness). However, the overboosting effect disclosed herein is based on the characteristic initial jump in octane boost when blended and then peaking at or before 40% (v/v). After this peak octane, adding more of the compounds produces a reduction in boosting effect, where higher blend volumes start to reduce the RON back down. This is another indicator of the overboosting effect.

These compounds are impactful because they suggest this octane overboosting effect may be more broadly applicable to the biofuel/refinery industries. If properly leveraged, the octane hyperboosting phenomenon could allow existing refineries and prospecting biorefiners to optimize biofuel/petroleum hydrocarbon mixtures for high performance fuels that neither can achieve on their own. Additionally, the fact that these molecules boost RON so synergistically may make them new targets for biofuel production. Five of these six biofuel candidates demonstrating this effect are molecules that have established routes to biological production (excluding 2,3 dimethyl-2-butene), that is, they are biorenewable. Although none of these additives are currently cost competitive with petroleum fuel products, the small amounts needed to immediately boost octane makes them promising candidates for focusing refining and production efforts, which could increase supply and reduce costs even more.

In an embodiment, the fuel blend composition is exclusive of an alkenol additive, such as prenol or isoprenol.

Exemplary amounts of the overboosting additive include 5% (v/v) to 20% (v/v), 5% (v/v) to 30% (v/v), 5% (v/v) to 40% (v/v), 5% (v/v) to 50% (v/v), 10% (v/v) to 60% (v/v), 10% (v/v) to 70% (v/v), 10% (v/v) to 80% (v/v), 10% (v/v) to 85% (v/v), 10% (v/v) to 90% (v/v), 10% (v/v) to 95% (v/v), 15% (v/v) to 30% (v/v), 20% (v/v) to 40% (v/v), 20% (v/v) to 50% (v/v), 20% (v/v) to 60% (v/v), 20% (v/v) to 70% (v/v), 20% (v/v) to 80% (v/v), 20% (v/v) to 85% (v/v), 20% (v/v) to 90% (v/v), 20% (v/v) to 95% (v/v), 25% (v/v) to 30% (v/v), 25% (v/v) to 40% (v/v), 25% (v/v) to 50% (v/v), 25% (v/v) to 60% (v/v), 25% (v/v) to 70% (v/v), 25% (v/v) to 80% (v/v), 25% (v/v) to 85% (v/v), 25% (v/v) to 90% (v/v), 25% (v/v) to 95% (v/v), 30% (v/v) to 40% (v/v), 30% (v/v) to 50% (v/v), 30% (v/v) to 60% (v/v), 30% (v/v) to 70% (v/v), 30% (v/v) to 80% (v/v), 30% (v/v) to 85% (v/v), 30% (v/v) to 90% (v/v), 30% (v/v) to 95% (v/v), 35% (v/v) to 40% (v/v), 35% (v/v) to 50% (v/v), 35% (v/v) to 60% (v/v), 35% (v/v) to 70% (v/v), 35% (v/v) to 80% (v/v), 35% (v/v) to 85% (v/v), 35% (v/v) to 90% (v/v), 35% (v/v) to 95% (v/v), 40% (v/v) to 50% (v/v), 40% (v/v) to 60% (v/v), 40% (v/v) to 70% (v/v), 40% (v/v) to 80% (v/v), 40% (v/v) to 85% (v/v), 40% (v/v) to 90% (v/v), 40% (v/v) to 95% (v/v), 45% (v/v) to 50% (v/v), 45% (v/v) to 60% (v/v), 45% (v/v) to 70% (v/v), 45% (v/v) to 80% (v/v), 45% (v/v) to 85% (v/v), 45% (v/v) to 90% (v/v), 45% (v/v) to 95% (v/v), 50% (v/v) to 60% (v/v), 50% (v/v) to 70% (v/v), 50% (v/v) to 80% (v/v), 50% (v/v) to 85% (v/v), 50% (v/v) to 90% (v/v), 50% (v/v) to 95% (v/v), 55% (v/v) to 60% (v/v), 55% (v/v) to 70% (v/v), 55% (v/v) to 80% (v/v), 55% (v/v) to 85% (v/v), 55% (v/v) to 90% (v/v), 55% (v/v) to 95% (v/v), 60% (v/v) to 70% (v/v), 60% (v/v) to 80% (v/v), 60% (v/v) to 85% (v/v), 60% (v/v) to 90% (v/v), 60% (v/v) to 95% (v/v), 65% (v/v) to 70% (v/v), 65% (v/v) to 80% (v/v), 65% (v/v) to 85% (v/v), 65% (v/v) to 90% (v/v), 65% (v/v) to 95% (v/v), 70% (v/v) to 80% (v/v), 70% (v/v) to 85% (v/v), 70% (v/v) to 90% (v/v), 70% (v/v) to 95% (v/v), 75% (v/v) to 80% (v/v), 75% (v/v) to 90% (v/v), 75% (v/v) to 95% (v/v), 80% (v/v) to 85% (v/v), 80% (v/v) to 90% (v/v), 80% (v/v) to 95% (v/v), 85% (v/v) to 90% (v/v), 85% (v/v) to 95% (v/v), and 90% (v/v) to 95% (v/v).

In an embodiment, the overboosting additive is present in an amount of from 10% (w/w) to 95% (w/w) (e.g., 10% (w/w) to 15% (w/w), 10% (w/w) to 20% (w/w), 10% (w/w) to 30% (w/w), 10% (w/w) to 40% (w/w), 10% (w/w) to 50% (w/w), 10% (w/w) to 60% (w/w), 10% (w/w) to 70% (w/w), 10% (w/w) to 80% (w/w), 10% (w/w) to 90% (w/w), 15% (w/w) to 20% (w/w), 15% (w/w) to 30% (w/w), 15% (w/w) to 40% (w/w), 15% (w/w) to 50% (w/w), 15% (w/w) to 60% (w/w), 15% (w/w) to 70% (w/w), 15% (w/w) to 80% (w/w), 15% (w/w) to 90% (w/w), 15% (w/w) to 95% (w/w), 20%

(w/w) to 30% (w/w), 20% (w/w) to 40% (w/w), 20% (w/w) to 50% (w/w), 20% (w/w) to 60% (w/w), 20% (w/w) to 70% (w/w), 20% (w/w) to 80% (w/w), 20% (w/w) to 90% (w/w), 20% (w/w) to 95% (w/w), 25% (w/w) to 30% (w/w), 25% (w/w) to 40% (w/w), 25% (w/w) to 50% (w/w), 25% (w/w) to 60% (w/w), 25% (w/w) to 70% (w/w), 25% (w/w) to 80% (w/w), 25% (w/w) to 90% (w/w), 25% (w/w) to 95% (w/w), 30% (w/w) to 40% (w/w), 30% (w/w) to 50% (w/w), 30% (w/w) to 60% (w/w), 30% (w/w) to 70% (w/w), 30% (w/w) to 80% (w/w), 30% (w/w) to 90% (w/w), 30% (w/w) to 95% (w/w), 35% (w/w) to 40% (w/w), 35% (w/w) to 50% (w/w), 35% (w/w) to 60% (w/w), 35% (w/w) to 70% (w/w), 35% (w/w) to 80% (w/w), 35% (w/w) to 90% (w/w), 35% (w/w) to 95% (w/w), 40% (w/w) to 50% (w/w), 40% (w/w) to 60% (w/w), 40% (w/w) to 70% (w/w), 40% (w/w) to 80% (w/w), 40% (w/w) to 90% (w/w), 40% (w/w) to 95% (w/w), 45% (w/w) to 50% (w/w), 45% (w/w) to 60% (w/w), 45% (w/w) to 70% (w/w), 45% (w/w) to 80% (w/w), 45% (w/w) to 90% (w/w), 45% (w/w) to 95% (w/w), 50% (w/w) to 60% (w/w), 50% (w/w) to 70% (w/w), 50% (w/w) to 80% (w/w), 50% (w/w) to 90% (w/w), 50% (w/w) to 95% (w/w), 55% (w/w) to 60% (w/w), 55% (w/w) to 70% (w/w), 55% (w/w) to 80% (w/w), 55% (w/w) to 90% (w/w), 55% (w/w) to 95% (w/w), 60% (w/w) to 70% (w/w), 60% (w/w) to 80% (w/w), 60% (w/w) to 90% (w/w), 60% (w/w) to 95% (w/w), 65% (w/w) to 70% (w/w), 65% (w/w) to 80% (w/w), 65% (w/w) to 90% (w/w), 65% (w/w) to 95% (w/w), 70% (w/w) to 80% (w/w), 70% (w/w) to 90% (w/w), 70% (w/w) to 95% (w/w), 75% (w/w) to 80% (w/w), 75% (w/w) to 90% (w/w), 75% (w/w) to 95% (w/w), 80% (w/w) to 90% (w/w), 80% (w/w) to 95% (w/w), 85% (w/w) to 90% (w/w), 85% (w/w) to 95% (w/w), and 90% (w/w) to 95% (w/w)).

In an embodiment, the fuel blend comprises a majority portion of a conventional fuel selected from the group consisting of: gasoline, alcohols (for example, ethanol, methanol, or butanol), or combinations thereof, and a minority portion of the additive compound. For example, the majority portion may be a blend of gasoline and ethanol, such as, but not limited to, the 10% ethanol in gasoline blends currently sold as pump gasoline in the U.S. In an embodiment, the majority portion fuel comprises 51% to 99.9% of the total fuel by liquid volume, such as, for example, 60% to 98%, or 80% to 95%, and the minority portion of the fuel is the additive, for example, 5% to 0.01%, 20% to 5%, or 40% to 10% of the total fuel by liquid volume. In an embodiment, the majority portion fuel is present in a volume ratio with the additive in a ratio of 99.9 (fuel):0.1 (additive) to 60:40, 95:5 to 65:35, or 90:10 to 70:30.

In an embodiment herein, the fuel is selected from the group consisting of a gasoline, a biofuel, a blendstock, a hydrocarbon, and a combination thereof. In other embodiments, the fuel is selected from the group of conventional gasoline, oxygenated gasoline, reformulated gasoline, biofuel, biogasoline, biodiesel, Fischer-Tropsch gasoline, petroleum blendstock, blendstock for oxygenate blending (BOB), reformulated blendstock for oxygenated blending (RBOB), conventional blendstock for oxygenate blending (CBOB), premium blendstock for oxygenate blending (PBOB), gasoline treated as blendstock (GTAB), crude oil, fuel oil, distillate fuel oil, diesel fuel, jet fuel, petroleum, a combination thereof, or any other described herein. In yet other embodiments, the fuel includes an alkylate, a paraffin, an olefin, a reformate, a naphthene, a ketone, an aromatic, a combination thereof, or any other described herein.

In an embodiment herein, the fuel mixture includes butane, pentane, heptane, octane, hexene, toluene, or a combination thereof.

The fuel can be a neat fuel or a blended fuel, such as, for example, conventional pump fuels. The blended fuels can include two or more chemical components. In some embodiments, the fuel or fuel mixture includes one or more components that are volatile and suitable for use in spark ignition engines and/or advanced compression ignition engines.

Exemplary fuels and fuel mixtures can include chemical components, including, e.g., an alkylate (e.g., isoparaffin), a paraffin (e.g., normal paraffins, iso-paraffins), an olefin (e.g., butylene, such as di-isobutylene, and a pentene (e.g., 2,4,4-trimethyl-1-pentene and/or 2,4,4-trimethyl-2-pentene)), a reformate (e.g., aromatics), a naptha (e.g., n-, iso-, cyclo-paraffin), a naphthene (e.g., cycloparaffins), a ketone (e.g., butanone (e.g., 3-methyl-2-butanone), pentanone (e.g., 2-pentanone, 3-pentanone, 4-methyl-2-pentanone, 2,4-dimethyl-3-pentanone, and cyclopentanone), hexanone, a cyclic ketone (e.g., cyclopentanone) or a ketone mixture), an aromatic (e.g., single ring and multi-ring aromatics, such as toluene), an alcohol (e.g., methanol, ethanol, propanol (e.g., 1-propanol and iso-propanol), butanol (e.g., 1-butanol, 2-butanol, iso-butanol, and 2-methylbutan-1-ol), and pentanol (e.g., 2-pentanol)), an alkene (e.g., a butylene (e.g., such as di-isobutylene), hexene (e.g., 1-hexene), etc.), an alkane (e.g., a branched alkane, such as 2,2,3-trimethylbutane; and butane (e.g., n-butane), pentane, heptane (e.g., n-heptane), octane (e.g., iso-octane), etc.), a fatty acid (including esters thereof, e.g., simple fatty acid esters and/or volatile fatty acid esters), a fatty ester, a furan (e.g., 2,5-dimethylfuran, 2-methylfuran, and combinations thereof), an ether (e.g., anisole), an ester (e.g., an acetate (e.g., methyl acetate, ethyl acetate, iso-propyl acetate, butyl acetate, 2-methylpropyl acetate, and 3-methylpropyl acetate), a butanoate (e.g., methyl butanoate, methyl isobutanoate, methyl-2-methylbutanoate, ethyl butanoate, and ethyl isobutanoate), a pentanoate (e.g., methyl pentanoate), and mixed esters), an oxygenate (e.g., an alcohol including a polyol, such as propanol (e.g., 1- or 2-propanol), ethanol, butanol (e.g., 1- or 2-butanol), diol (e.g., 1,3-propanediol and 2,3-butanediol), triol (e.g., glycerol); or a carboxylic acid (e.g., acetic acid)), an aldehyde (e.g., prenal), a carboxylic acid, a multicomponent mixture (e.g., methanol-to-gasoline, ethanol-to-gasoline, bioreformate via multistage pyrolysis, bioreformate via catalytic conversion of sugar, mixed aromatics via catalytic fast pyrolysis, and aromatics and olefins via pyrolysis-derived sugars), as well as combinations and/or isomers of any of these. Each of these chemical components can be present in the fuel, as well as employed as a blending component with other oxygenate(s) and/or fuel(s) to provide a finished fuel product having desired fuel standards.

Exemplary fuels also include gasoline, oxygenated gasoline, reformulated gasoline, biofuel (e.g., a fuel derived from a biomass containing biological material, such as those including plants, plant-derived materials, bacteria, fungi, and/or algae), biogasoline, biodiesel, bioblendstock (including component(s) produced from biomass, e.g., components such as cellulosic ethanol, methanol, butanol, triptane-rich blend, mixed aromatics, mixed ketones, an iso-olefin mixture, etc.), Fischer-Tropsch gasoline, petroleum blendstock, blendstock for oxygenate blending (BOB), reformulated blendstock for oxygenated blending (RBOB), conventional blendstock for oxygenate blending (CBOB), premium blendstock for oxygenate blending (PBOB), CARBOB (an RBOB suitable for use in California as regulated by the California Air Resources Board), gasoline treated as blendstock (GTAB), crude oil, fuel oil, distillate fuel oil, diesel fuel, jet fuel, petroleum, a natural gas liquid (e.g., any isomer and combination of methane, ethane, propane, butane, pentane, hexane, heptane, as well as higher molecular weight hydrocarbons, and mixtures thereof), a hydrocarbon (e.g., any described herein), a surrogate fuel (e.g., octane (e.g., iso-octane), toluene, heptane, or hexene (e.g., 1-hexene)), a core fuel (e.g., alkylate, E30 (a blend of 30% ethanol in fuel component(s)), aromatics, cycloparaffins, and olefins), and combinations thereof.

In some embodiments, the fuel includes a surrogate fuel. An exemplary surrogate fuel (e.g., surrogate gasoline) can include octane (e.g., iso-octane) and heptane (e.g., n-heptane). Another exemplary surrogate fuel (e.g., surrogate gasoline) can include octane (e.g., iso-octane), heptane (e.g., n-heptane), toluene, and hexene (e.g., 1-hexene) (e.g., iso-octane (55 vol %), n-heptane (15 vol %), toluene (25 vol %), and 1-hexene (5 vol %)). Yet another exemplary surrogate fuel (e.g., surrogate jet fuel) can include decane, dodecane, methylcyclohexane, and toluene. Another exemplary surrogate fuel (e.g., surrogate diesel) can include hexadecane. Another exemplary surrogate fuel (e.g., surrogate biodiesel) can include methyl butyrate and methyl decanoate.

In particular embodiments, the fuel includes component(s) obtained from processing a biomass (e.g., oil crops, algae, yeast, bacteria, etc.). Exemplary components from such biomass can include alcohols, aldehydes, aromatics, carboxylic acids, cyclic fatty acids, esters, ethers, fatty acid esters, furanics, isoprenoids, ketones, naphthenics, olefins, polyketides, terpenes, etc.

Fuels and fuel mixtures, including blendstocks, optionally may include other chemicals and additives to adjust properties of the fuel and/or to facilitate fuel preparation. Examples of such chemicals or additives include detergents, antioxidants, stability enhancers, demulsifiers, corrosion inhibitors, metal deactivators, antiknock additives, valve seat recession protectant compounds, dyes, diluents, friction modifiers, markers, solvents, carrier solutions (e.g., mineral oil, alcohols, carboxylic acids, synthetic oils, etc.), etc. More than one additive or chemical can be used.

The additives described herein may be used for fuels for use in various internal combustion engines. In particular, the additives can also be used as a blending agent for fuels for use in spark-ignition engines. The fuel blends disclosed herein may have particular benefits in boosted engines, such as turbo-boosted or supercharged engines because of the increased octane which imparts high resistance to autoignition property change under boosted conditions. The additives may also be used in HCCI (homogenous charge compression ignition) engines, or, more generally LTGC (low temperature gas combustion) engines. These engines are known in the art and do not require extensive description to those skilled in the art.

This reduction in the autoignition temperature of the fuel can also allow for internal combustion engines that are designed to have an increased boost and/or increased compression ratios. For example, with an octane boosting agent, the compression ratio (CR) and/or intake-pressure boost (i.e. turbocharging or supercharging) may be increased by 5% to 50%, such as 10% to 40%, or 15% to 30% higher. For example, the CR units of the engine may be increased from 8:1, 9:1, or 10:1 to 15:1, such as, for example, up to 14:1, or up to 13:1. Boost levels might be increased from 1.5 bar to 4 bar (absolute), such as 2 bar to 3 bar (absolute), or 1 bar to 2.5 bar.

A method for powering an internal combustion engine includes combusting a fuel blended with an additive to drive a piston or rotor in a cylinder of the engine. The fuel comprises an additive selected from the group consisting of: myrcene, geraniol, 2,3-dimethyl-2-butene, alloocimene, limonene, dimethyl prenol, or combinations thereof. In an embodiment, the fuel is a majority portion of the total fuel used in the engine. In an embodiment, the method further comprises boosting the intake pressure of the engine to 1.1 to 4 bar, such as, for example, 2.4 to 3 bar, or 2.2 bar to 2.6 bar.

The blending of the fuel and the additive compound can be performed at the pump, for example, as a blending agent blended into the fuel in the underground containers at the filling station. In another example, two separate tanks at the filling station would be filled, one with a conventional fuel, e.g. gasoline or diesel, and one with the additive, and they would come together and be mixed in the pump, as the vehicle is fueled. The blending agent can also be added directly to the gas tank of a vehicle that is separately filled with fuel. It could also be blended at the supplier just prior to shipment to a filling station.

In an embodiment, the additive is present in an amount such that a RON of the fuel mixture is greater than the individual RON of the base fuel and the individual RON of the additive. In an embodiment, the additive is present in an amount sufficient to produce a boost of at least 1 RON at only 10% volume in the fuel mixture, and the additive is characterized in that it produces a RON enhancement that is observed to peak at or before 40% (v/v).

In an embodiment, the fuel, prior to blending the over-boosting additive has a RON of 50 to 150, such as for example, 50 to 75, 80 to 90, or 92 to 125. In an embodiment, low-cost, low-octane fuels, may have their RON raised with the additive, so that the RON of the blend is increased to a level that is useful in conventional commercial vehicles, or to higher octane levels for boosted or higher compression ratio engines. In an embodiment, the additive may also be used as a blending agent in fuels with higher octane ratings, such as currently available pump gasolines (regular, mid-grade and premium) to create a fuel with an octane rating above current premium gasoline. This would enable the combined fuel to be effective with new or modified engines that have higher boost capacities and/or compression ratios than are currently widely used. In an embodiment, the additive compound is added in an amount effective to raise the RON of the total blended fuel above that of the majority portion of the fuel by an amount sufficient to allow higher compression ratios and/or boost that in current engines. It is expected that RON of the fuel blend can be raised, for example, 5% to 100% higher, such as 10% to 50%, or 15% to 30%, higher than the RON of the neat fuel. In particular, the RON of a low octane fuel could be raised much higher with a substantial portion of the additive. In an embodiment, the additive compound is added in an amount wherein the autoignition temperature at 1.1 to 4 bar intake pressure (boosted conditions) of the total blended fuel is 5 to 50% higher than the autoignition temperature of the majority portion of the fuel. Autoignition temperature as used herein is the temperature in the cylinder at the time of autoignition in Kelvin. For example, at 2.4 bar intake pressure, the autoignition temperature of the total blended fuel may be 5% to 50% higher than the autoignition temperature of the majority portion of the fuel, such as 10% to 40%, or 15% to 30% higher.

In an embodiment, the fuel mixture includes two or more additives selected from the group consisting of: prenol, myrcene, geraniol, 2,3-dimethyl-2-butene, alloocimene, limonene, or dimethyl prenol. For example, the fuel mixture may include 5% (v/v) to 5% (v/v) of the first additive and of from 5% (v/v) to 95% (v/v) of the second additive (based on total fuel mixture volume). Non-limiting amounts of the first additive and the second additive include 5% (v/v) to 95% (v/v) (e.g., 5% (v/v) to 10% (v/v), 5% (v/v) to 15% (v/v), 5% (v/v) to 20% (v/v), 5% (v/v) to 30% (v/v), 5% (v/v) to 40% (v/v), 5% (v/v) to 50% (v/v), 5% (v/v) to 60% (v/v), 5% (v/v) to 70% (v/v), 5% (v/v) to 80% (v/v), 5% (v/v) to 90% (v/v), 10% (v/v) to 15% (v/v), 10% (v/v) to 20% (v/v), 10% (v/v) to 30% (v/v), 10% (v/v) to 40% (v/v), 10% (v/v) to 50% (v/v), 10% (v/v) to 60% (v/v), 10% (v/v) to 70% (v/v), 10% (v/v) to 80% (v/v), 10% (v/v) to 90% (v/v), 10% (v/v) to 95% (v/v), 15% (v/v) to 20% (v/v), 15% (v/v) to 30% (v/v), 15% (v/v) to 40% (v/v), 15% (v/v) to 50% (v/v), 15% (v/v) to 60% (v/v), 15% (v/v) to 70% (v/v), 15% (v/v) to 80% (v/v), 15% (v/v) to 90% (v/v), 15% (v/v) to 95% (v/v), 20% (v/v) to 30% (v/v), 20% (v/v) to 40% (v/v), 20% (v/v) to 50% (v/v), 20% (v/v) to 60% (v/v), 20% (v/v) to 70% (v/v), 20% (v/v) to 80% (v/v), 20% (v/v) to 90% (v/v), 20% (v/v) to 95% (v/v), 25% (v/v) to 30% (v/v), 25% (v/v) to 40% (v/v), 25% (v/v) to 50% (v/v), 25% (v/v) to 60% (v/v), 25% (v/v) to 70% (v/v), 25% (v/v) to 80% (v/v), 25% (v/v) to 90% (v/v), 25% (v/v) to 95% (v/v), 30% (v/v) to 40% (v/v), 30% (v/v) to 50% (v/v), 30% (v/v) to 60% (v/v), 30% (v/v) to 70% (v/v), 30% (v/v) to 80% (v/v), 30% (v/v) to 90% (v/v), 30% (v/v) to 95% (v/v), 35% (v/v) to 40% (v/v), 35% (v/v) to 50% (v/v), 35% (v/v) to 60% (v/v), 35% (v/v) to 70% (v/v), 35% (v/v) to 80% (v/v), 35% (v/v) to 90% (v/v), 35% (v/v) to 95% (v/v), 40% (v/v) to 50% (v/v), 40% (v/v) to 60% (v/v), 40% (v/v) to 70% (v/v), 40% (v/v) to 80% (v/v), 40% (v/v) to 90% (v/v), 40% (v/v) to 95% (v/v), 45% (v/v) to 50% (v/v), 45% (v/v) to 60% (v/v), 45% (v/v) to 70% (v/v), 45% (v/v) to 80% (v/v), 45% (v/v) to 90% (v/v), 45% (v/v) to 95% (v/v), 50% (v/v) to 60% (v/v), 50% (v/v) to 70% (v/v), 50% (v/v) to 80% (v/v), 50% (v/v) to 90% (v/v), 50% (v/v) to 95% (v/v), 55% (v/v) to 60% (v/v), 55% (v/v) to 70% (v/v), 55% (v/v) to 80% (v/v), 55% (v/v) to 90% (v/v), 55% (v/v) to 95% (v/v), 60% (v/v) to 70% (v/v), 60% (v/v) to 80% (v/v), 60% (v/v) to 90% (v/v), 60% (v/v) to 95% (v/v), 65% (v/v) to 70% (v/v), 65% (v/v) to 80% (v/v), 65% (v/v) to 90% (v/v), 65% (v/v) to 95% (v/v), 70% (v/v) to 80% (v/v), 70% (v/v) to 90% (v/v), 70% (v/v) to 95% (v/v), 75% (v/v) to 80% (v/v), 75% (v/v) to 90% (v/v), 75% (v/v) to 95% (v/v), 80% (v/v) to 90% (v/v), 80% (v/v) to 95% (v/v), 85% (v/v) to 90% (v/v), 85% (v/v) to 95% (v/v), and 90% (v/v) to 95% (v/v). In an embodiment, the first and second additives may be in a ratio of 0.01 (first additive):1 (second additive) to 1:0.01, such as 0.1:1 to 1:0.1, or 0.5:1 to 1:0.5 in each case (v/v). The first and second or additional additives can be pre-blended or added separately.

In some embodiments, the method includes purifying the additive to provide a purified additive, which can then be employed during blending. In one instance, purifying includes removing one or more contaminations (before blending), such as polar contaminants (e.g., peroxides and/or hydrates).

In an embodiment, the method includes verifying the RON of the fuel mixture. In an embodiment, the method includes determining a RON of the fuel mixture, wherein the additive produces an increase of at least 1 RON at 10% (v/v) of additive in the fuel mixture, and the RON of the fuel mixture peaks at or before 40% of additive volume (v/v). The method may include verifying that the RON of the fuel mixture is greater than a RON of the additive and/or the RON of the base fuel.

EXAMPLES

Examples 1-7: Octane Overboosting Phenomena

Examples 1-6 described herein were procured from commercial vendors such as Sigma Aldrich or Tokyo Chemical Company. Compounds purchased were always high purity, >98%.

Example 7, dimethyl prenol, was synthesized via the following process: To a flame-dried, round bottomed flask under nitrogen that was equipped with a water-cooled reflux condenser, was added synthesis grade Mg turnings (124 g, 5.12 mol, 2.4 eq) and 200 mL of dry diethyl ether. 0.10 mL of dibromoethane was added to active the Mg surface and gas evolution was observed. The flask was then cooled to 0° C., rapidly stirred, and a solution of 292 mL of methyl iodide in 1100 mL of dry diethyl ether (4.69 mol, 2.2 eq) was added dropwise via cannula over 2 hours, with temperature maintained at 0° C., to yield a dark gray/brown colored solution. When the addition was completed, the flask was warmed to 45° C. and held overnight to complete the reaction.

The flask was then cooled to 0° C. and a solution of ethyl prenate (273 g, 2.13 mol, 1 eq) in 600 mL of dry diethyl ether was added dropwise via cannula over 2 hours, with temperature maintained at 0° C. Upon warming to room temperature and stirring overnight, a gray solid precipitated from the reaction mixture. The liquid phase was quenched by dropwise addition to a rapidly stirred solution of saturated, aqueous NH4Cl at 0° C. The precipitate also contained entrained product and was quenched portionwise by addition to saturated, aqueous NH4Cl at 0° C.

The quenched organic layers were combined and diluted with 500 mL diethyl ether, separated from NH4Cl solution, washed 3×500 mL deionized water and 1×100 mL brine. The organic layer was then dried over anhydrous $MgSO_4$, filtered, and concentrated in vacuo at 40° C., 300 Torr. The crude product was purified via bulb-to-bulb vacuum transfer at room temperature and 100 mT, using a liquid-nitrogen cooled receiving flask. Isolated yield: 137 g (56%) at >99% NMR purity. 1H NMR (500 MHz, C6D6) δ 5.25 (s, 1H), 1.81 (s, 3H), 1.59 (s, 3H), 1.25 (s, 6H), 0.98 (s, 1H). $^{13}C$ NMR (126 MHz, C6D6) δ 133.21, 133.05, 70.53, 31.51, 27.22, 18.73.

Figure 4:
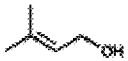
FIG. 4 is a table with overboosting chemical compounds with fuel blend profile data.
Figure 4:
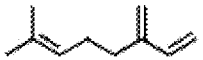
Figure 4:
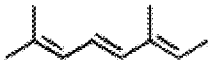
Figure 4:
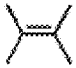
Figure 4:
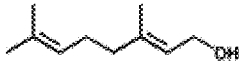
Figure 4:
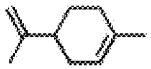
Figure 4:
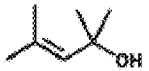
Figure 5:
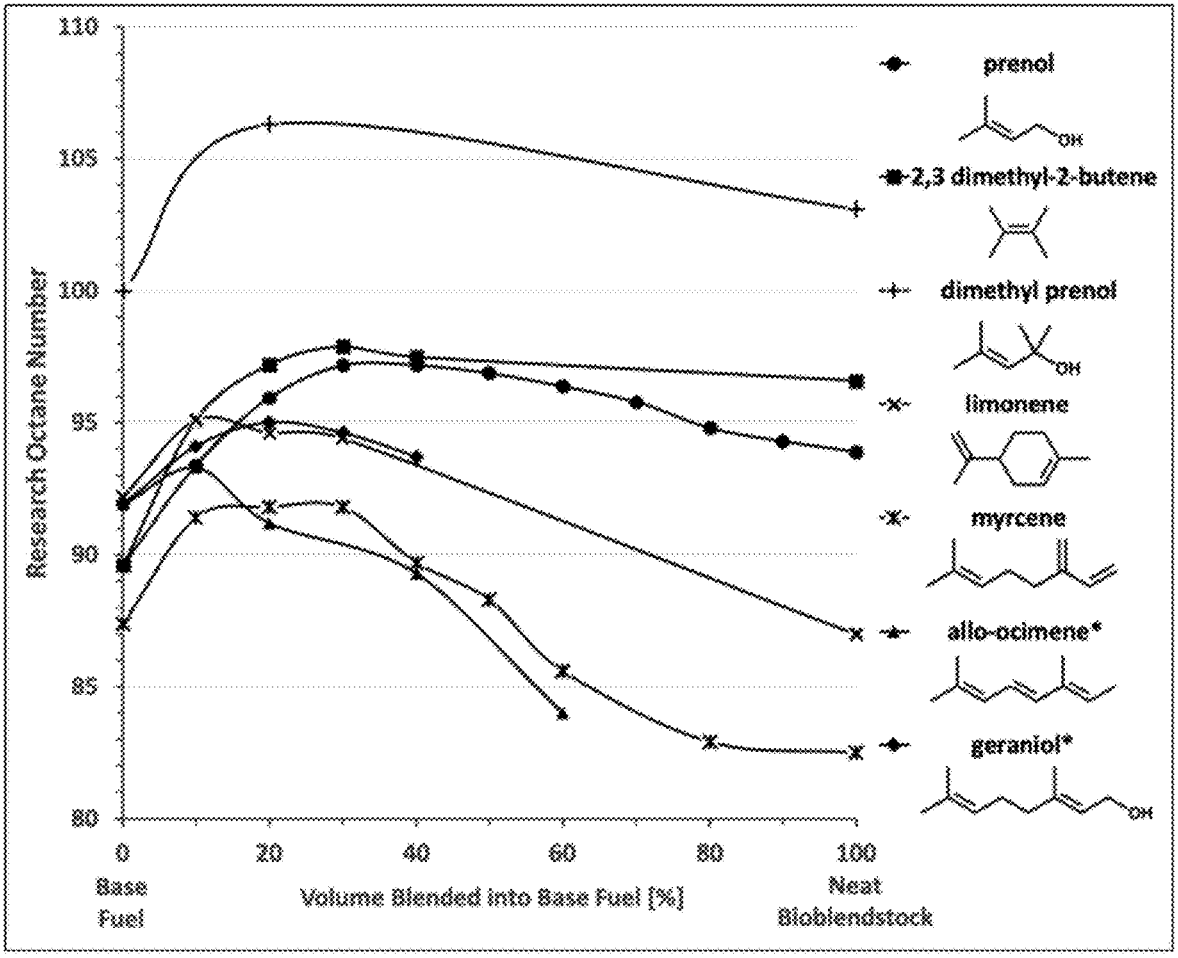
FIG. 5 is a graph showing blend profiles for several overboosting compounds.

Each compound was blended volumetrically into different gasoline blendstocks as shown in FIG. 4 and graphically depicted in FIG. 5. These blendstocks were either commercial gasoline fuels (PNNL CARBOB 3), research gasoline fuels (RD 587), or simplified surrogate mixtures meant to represent gasoline blendstocks but with more precise control over the Research Octane Number (RON).

Starting RON values varied for the different base fuels and are listed in the Table in FIG. 4. The simplified surrogate gasoline consisted of iso-octane (55 vol %), n-heptane (15 vol %), toluene (25 vol %), and 1-hexene (5 vol %) that has been used as a base fuel for comparing blending octane numbers for a wide range of potential high-octane gasoline blendstocks. These 4 compounds were selected to be representative of the major classes of hydrocarbons found in gasoline (See, e.g., McCormick R L et al., *SAE Int'l J. Fuels Lubr.* 2017; 10:442-60; Cai L et al., "Optimized chemical mechanism for combustion of gasoline surrogate fuels," *Combust. Flame* 2015; 162:1623-37; and Mehl M et al., "An approach for formulating surrogates for gasoline with application toward a reduced surrogate mechanism for CFD engine modeling," *Energy Fuels* 2011; 25:5215-23). This surrogate blend has been used as a base fuel for RON measurements since it was easy for computational modeling since it was much simpler than real gasoline, but it was designed to replicate real gasoline's blending traits.

The Research Octane Number (RON) of these mixtures in different blend ratios were measured. RON were determined via the ASTM D2699 method utilizing a CFR engine. More than one commercial laboratory capable of running the ASTM D2699 was used to ensure robust data quality and reproducibility with a facility at Intertek, Benecia, C A and a facility at Southwest Research Institute, San Antonio, Tex. was utilized. One of the operating conditions of both the RON and MON tests is that the fuel level in the vertical jet, at maximum knock intensity, must be between 1.78 and 4.32 cm below the center line of the venturi. Due to the lower stoichiometric air/fuel mass ratio of the high prenol containing samples, the jet size was increased to allow for the higher fuel flow needed to maintain the required fuel level (Ref available). This issue was not present with any of the other overboosting candidates as they have a higher C:O ratio.

As stated, the purity of the additive sample evaluated was always >98%.

For fuels in the 90 to 100 RON range, the method reproducibility is ±0.7 ON (repeated tests would differ by more than 0.7 ON, no more than 5% of the time) (see, e.g., ASTM International, "Standard test method for Research Octane Number of spark-ignition engine fuel," Designation No. ASTM D2699-16, West Conshohocken, Pa., 2016). The absolute value of the average error from the target volume range for the samples that were determined was 1.39 volume % so the samples that were not quantified by GC can be expected to have a similar blending volume error. Multiple gasoline samples were used to address variability in materials.

Comparative Example 8

Figure 6:
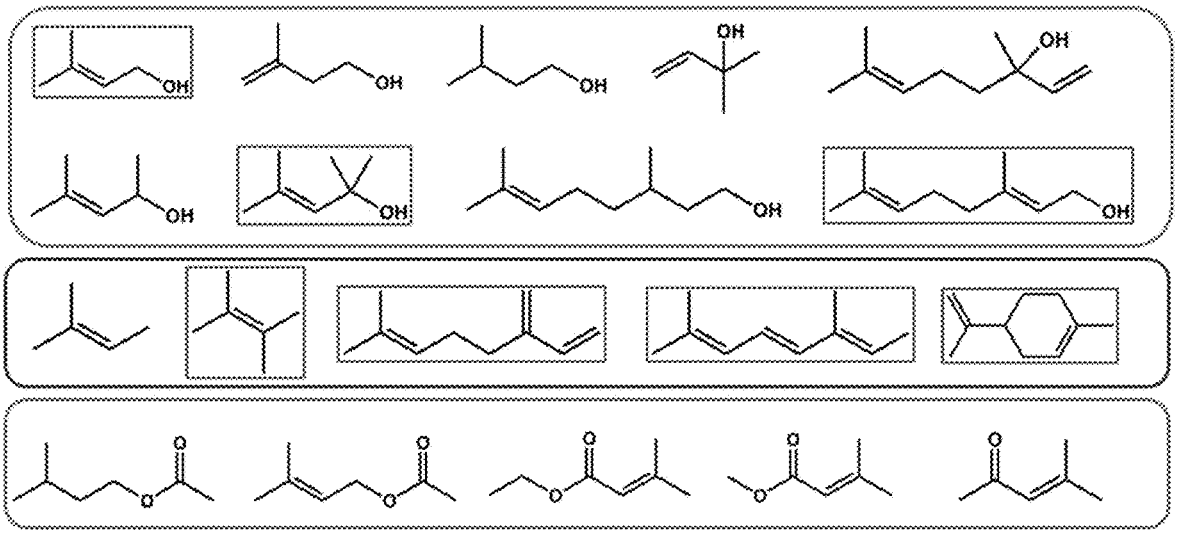
FIG. 6 shows a selection of compounds that were tested for overboosting effect with those that showed this effect in squares.

Testing of numerous compounds chemically similar to those disclosed herein yielded no qualitatively similar instances of octane overboosting, which demonstrates unpredictability in what compounds will produce the overboosting effect. Some of these compounds are shown in FIG. 6, along with the overboosting compounds. The overboosting compounds are designated in squares.

As described herein, octane overboosting additives are provided that surprisingly increase octane of a fuel at low concentrations. This is distinct from conventional synergistic blending of oxygenates with gasoline that has been observed.

While the technology disclosed herein has been described in connection with specific embodiments thereof, it will be understood that it is capable of further modifications and this application is intended to cover any variations, uses, or adaptations of the technology following, in general, the principles of the technology and including such departures from the present disclosure that come within known or customary practice within the art to which the technology pertains and may be applied to the essential features hereinbefore set forth, and follows in the scope of the claims.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim. The term "consisting essentially" as used herein means the specified materials or steps and those that do not materially affect the basic and novel characteristics of the material or method. Unless the context indicates otherwise, all percentages and averages are by weight. If not specified above, the properties mentioned herein may be determined by applicable ASTM standards, or if an ASTM standard does not exist for the property, the most commonly used standard known by those of skill in the art may be used. The articles "a," "an," and "the," should be interpreted to mean "one or more" unless the context indicates the contrary.

The invention claimed is:

1. A fuel mixture comprising:

a fuel; and an octane boosting additive present in the fuel mixture at a volume of 5% or more (v/v) of the fuel mixture;

the octane boosting additive being a $C_5$ to $C_{24}$ alkenyl compound containing one or more internal carbon-carbon double bonds, and multiple carbon atoms with covalent bonds only to other carbon atoms;

wherein the octane boosting additive is selected from the group consisting of: myrcene, geraniol, 2,3-dimethyl-2-butene, alloocimene, limonene, dimethyl prenol, or combinations thereof.

2. The fuel mixture of claim 1, wherein the fuel is selected from the group consisting of gasoline, oxygenated gasoline, reformulated gasoline, biofuel, biogasoline, biodiesel, Fischer-Tropsch gasoline, petroleum blendstock, blendstock for oxygenate blending (BOB), reformulated blendstock for oxygenated blending (RBOB), conventional blendstock for oxygenate blending (CBOB), premium blendstock for oxygenate blending (PBOB), gasoline treated as blendstock (GTAB), crude oil, fuel oil, distillate fuel oil, diesel fuel, jet fuel, petroleum, a surrogate fuel, and a combination thereof.

3. The fuel mixture of claim 2, wherein the fuel comprises gasoline.

4. The fuel mixture of claim 1, wherein the fuel mixture is exclusive of an alkenol additive.

5. The fuel mixture of claim 1, wherein a Research Octane Number (RON) of the fuel mixture is greater than a RON of the octane boosting additive and the fuel.

6. The fuel mixture of claim 1, wherein the octane boosting additive is selected from the group consisting of: myrcene, 2,3 diemethyl-2-butene, or dimethyl prenol.

7. The fuel mixture of claim 1, wherein the octane boosting additive is present in an amount of 10% (v/v) to 40% (v/v) of the fuel mixture.

8. The fuel mixture of claim 1, wherein the fuel mixture further comprises ethanol in an amount of 5% (v/v) to 50% (v/v) of the fuel mixture.

9. The fuel mixture of claim 1, wherein the fuel is a biofuel and the octane boosting additive is a biorenewable compound.

10. The fuel mixture of claim 1, wherein the octane boosting additive is present in an amount sufficient to produce an octane boost of at least 1 RON at only 10% volume in the fuel mixture, and the octane boosting additive is further characterized in that it produces a RON enhancement in the fuel mixture that is observed to peak at or before 40% (v/v).

11. The fuel mixture of claim 1, wherein the octane boosting additive is a $C_6$ to $C_{10}$ alkenyl.

12. The fuel mixture of claim 1, wherein the octane boosting additive is selected from the group consisting of: myrcene, geraniol, 2,3-dimethyl-2-butene, alloocimene, dimethyl prenol, or combinations thereof.

13. A fuel mixture comprising:

a fuel; and two or more octane boosting additives in an amount of 5% (v/v) or more, the two or more octane boosting additives being selected from the group consisting of: prenol, myrcene, geraniol, 2,3-dimethyl-2-butene, alloocimene, limonene, or dimethyl prenol.

14. The fuel mixture of claim 13, wherein the two or more octane boosting additives are present in an amount of 10% (v/v) to 40% (v/v).

15. The fuel mixture of claim 12, wherein the fuel comprises gasoline.

16. A method of preparing a fuel mixture or preparing and using a fuel mixture, the method comprising:

blending an octane boosting additive into a fuel in a volume of 5% (v/v) or more of the fuel mixture, the octane boosting additive being a $C_5$ to $C_{24}$ alkenyl compound containing one or more internal carbon-carbon double bonds, and multiple carbon atoms with covalent bonds only to other carbon atoms;

wherein the octane boosting additive is sufficient to produce an octane boost of at least 1 RON at only 10% volume in the fuel mixture, and the octane boosting additive is further characterized in that it produces a RON enhancement in the fuel mixture that is observed to peak at or before 40% (v/v).

17. The method of claim 16, wherein the octane boosting additive is selected from the group consisting of: myrcene, geraniol, 2,3-dimethyl-2-butene, alloocimene, limonene, dimethyl prenol, or combinations thereof.

18. The method of claim 16, further comprising after the blending step: determining a RON of the fuel mixture that is greater than a RON of the octane boosting additive and the fuel.

19. The method of claim 16, further comprising combusting the fuel mixture to drive a piston or rotor in a cylinder of an engine.

* * * * *